US008303272B2

(12) United States Patent
Pugh et al.

(10) Patent No.: US 8,303,272 B2
(45) Date of Patent: Nov. 6, 2012

(54) HYDRAULICALLY ACTUATED DOWNHOLE PUMP WITH GAS LOCK PREVENTION

(75) Inventors: Toby Pugh, Arlington, TX (US); John Kelleher, Woodward, OK (US); Clark Robison, Tomball, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 504 days.

(21) Appl. No.: 12/402,316

(22) Filed: Mar. 11, 2009

(65) Prior Publication Data

US 2010/0230091 A1 Sep. 16, 2010

(51) Int. Cl.
*F04B 17/00* (2006.01)

(52) U.S. Cl. ..... 417/401

(58) Field of Classification Search ..... 417/375, 417/399, 401

See application file for complete search history.

(56) References Cited

U.S. PATENT DOCUMENTS

| | | | | |
|---|---|---|---|---|
| RE24,812 | E | 4/1960 | Deitrickson | |
| 2,943,576 | A | 7/1960 | English | |
| 3,034,442 | A | 8/1960 | Coberly et al. | |
| 3,703,926 | A | 11/1972 | Roeder | |
| 4,026,661 | A * | 5/1977 | Roeder | 417/53 |
| 4,118,154 | A | 10/1978 | Roeder | |
| 4,214,854 | A | 7/1980 | Roeder | |
| 4,477,234 | A | 10/1984 | Roeder | |
| 4,867,242 | A | 9/1989 | Hart | |
| 4,871,302 | A | 10/1989 | Clardy et al. | |
| 5,097,902 | A * | 3/1992 | Clark | 166/187 |
| 2008/0003118 | A1 * | 1/2008 | Traylor et al. | 417/394 |

FOREIGN PATENT DOCUMENTS

| | | | |
|---|---|---|---|
| DE | 1278250 | B1 | 9/1968 |
| WO | 00/79132 | A2 | 12/2000 |
| WO | 02/101241 | A1 | 12/2002 |

OTHER PUBLICATIONS

Weatherford International Ltd. informational product brochure: "Hydraulic Lift Systems" Copyright 2006 Weatherford.

Weatherford International Ltd. informational product brochure: "Real Results: Freestyle Hydraulic Piston Pumps and 200 Water Bring Heavy-Oil Deposits to the Surface to Resore Production and Profitability" Copyright 2004-2006 Weatherford.

Weatherford International Ltd. informational product brochure: "Oilmaster Models F, V and 220 Series Pumps" Copyright 2002-2004 Weatherford.

(Continued)

*Primary Examiner* — Anh Mai
*Assistant Examiner* — Brenitra Lee
(74) *Attorney, Agent, or Firm* — Wong, Cabello, Lutsch, Rutherford & Brucculeri, LLP

(57) ABSTRACT

A hydraulic pump avoids problems with gas lock found in conventional pumps. The pump draws in production fluid in a lower pump volume during the pump's upstroke and diverts the produced fluid to an upper pump volume during the downstroke. Spent power fluid is communicated to the upper pump volume during the pump's upstroke. The pump piston in the upstroke expels the entire volume via a check valve that communicates the upper pump volume with a discharge outlet. The check valve increasing the discharge pressure of the upper pump volume, the upper pump volume of the spent power fluid being greater than the upper pump volume, and the upper pump piston compressing produced gas in the upper pump volume all combine to prevent or reduce the chances that the pump will gas lock during operation.

37 Claims, 7 Drawing Sheets

OTHER PUBLICATIONS

Weatherford International Ltd. informational product brochure: "Powerlift™ I & II Pumps" Copyright 2002-2005 Weatherford.
Weatherford International Ltd. informational product brochure: "Hydraulic Pumping Systems" Copyright 2003-2004 Weatherford.
Weatherford International Ltd. informational product brochure: "Kobe Type ALP Pump" Copyright 2002-2004 Weatherford.
Weatherford International Ltd. informational product brochure: "Hydraulic Piston Pumps" Copyright 2002-2004 Weatherford.
First Examination Report in counterpart EP Appl. No. 10 25 0456, dated Apr. 10, 2012.
First Office Action in counterpart Canadian Appl. No. 2,696,600, dated Dec. 14, 2011.
European Search Report in counterpart EP Appl. No. 10 25 0456, dated Feb. 28, 2012.
Machine Translation of DE 1278250 obtained from the EPO at http://translationportal.epo.org, Sep. 19, 1968.

* cited by examiner

HYDRAULICALLY ACTUATED DOWNHOLE PUMP WITH GAS LOCK PREVENTION

BACKGROUND

Pumps can be used in wells to produce production fluids to the surface. One well known type of pump is a hydraulically actuated pump known as the PowerLift I, such as disclosed in U.S. Pat. Nos. 2,943,576; 4,118,154; and 4,214,854. Details of a system having this type of pump are reproduced in FIG. 1. The pump 30 deploys downhole in tubing 16 disposed in a wellbore casing 12. Surface equipment 20 injects power fluid (e.g., produced water or oil) down the tubing 16 to the pump 30. The power fluid enters the pump's inlet 32 and operates the pump 30 internally between upstrokes and downstrokes. In its upstroke, the pump 30 draws production fluid from below a packer 14 into the pump's intake 34. As shown, the production fluid may enter the wellbore's casing 12 through perforations 13. Subsequently operated in its downstroke, the pump 30 discharges the produced fluid and spent power fluid into the tubing 16 via ports 36. The discharged fluid then passes through ports 18 in the production tubing 16 and eventually travels via the tubing-casing annulus to the surface equipment 20 for handling.

Internal details of the pump 30 and its operation are shown in FIGS. 2A-2B. The pump 30 has an engine piston 50, a reversing valve 60, and a pump piston 70. A rod 55 interconnects the engine piston 50 to the pump piston 70 so that the two pistons 50/70 move together in the pump 30. Power fluid used to actuate the pump 30 enters the pump 30 via inlet 32 and travels into an engine barrel 40 via ports 42. Inside the barrel 40, the power fluid acts on the engine piston 50. The reversing valve 60 within the engine piston 50 alternately directs the power fluid above and below the piston 50, causing the piston 50 to reciprocate within the engine's barrel 40. In the upstroke shown in FIG. 2A, mechanical force from a push rod 62 initiates the shifting of the reversing valve 60 downward, after which hydraulic force from the fluid continues to shift the valve 60 downward. This shifting diverts the power fluid to the volume of the barrel 40 above the engine piston 50, and the buildup of power fluid causes the engine piston 50 to move downward in the engine's barrel 40. In the downstroke shown in FIG. 2B, mechanical force and then hydraulic force shift the reversing valve 60 upward. The power fluid fills the barrel's volume below the engine piston 50 and causes the piston 50 to move upward.

The pump piston 70 connected to the engine piston 50 by rod 55 moves in tandem with the engine piston 50. When moved, the pump piston 70 operates similar to a conventional sucker rod pump. At the start of the upstroke shown in FIG. 2A, a traveling valve 75 closes, and a standing valve 35 opens. The fluid in the piston barrel 45 above the pump piston 70 is then displaced out of the pump's barrel 45 via port 36 as the pump piston 70 continues the upstroke. The fluid passes out tubing port 18 and then to the surface.

The upstroke reduces the pressure in the barrel 45 below the pump piston 70 so that the resulting suction allows production fluid to enter the barrel 45 through the open standing valve 34. At the start of the downstroke shown in FIG. 2B, the traveling valve 75 opens, and the standing valve 34 closes. This permits the production fluid that entered the lower part of the barrel 45 below the pump piston 70 to move above the piston 70 through the open traveling valve 75. In this way, this moved production fluid can be discharged to the surface on the next upstroke.

The hydraulically actuated pump 30 is preferred in many installations because initial movement of the reversing valve 60 is mechanically actuated. This allows the pump 30 to operate at low speeds and virtually eliminates the chances that the pump 30 will stall during operation. Unfortunately, the pump 30 can suffer from problems with gas lock, especially in a wellbore that produces excessive compressible fluids, such as natural gas, along with incompressible liquids, such as oil and water.

During operation, for example, the pump 30 can easily draw gas through the standing valve 34 during the piston's upstroke. On the downstroke with the standing valve 34 closed, incompressible fluid in the lower volume of the piston barrel 45 is expected to force the traveling valve 75 open. Because gas between the traveling valve 75 and the standing valve 34 will compress, the hydrostatic head of the fluid above the traveling valve 75 may keep the traveling valve 75 from opening. On the upstroke, the gas and liquid above the standing valve 34 may then prevent any more fluid from being drawn into the pump barrel 45 because the compressed gas merely expands to fill the expanding volume. When this occurs, the pump 30 will alternatingly cycle through upstrokes and downstrokes, but it will simply compress and expand the gas in the pump barrel 45 caught between the standing valve 34 and the traveling valve 75. When this gas lock occurs, the pump 30 fails to move any liquid to the surface.

Because gas lock can be an issue, operators may use other types of pumps that minimize the possibility of gas lock. One such pump is the Type F pump such as disclosed in U.S. Pat. No. Re 24,812. Functionally, the Type F pump operates in a similar way to the PowerLift I pump described above. To minimize gas lock, the Type F pump pressurizes produced fluid to discharge pressure. However, the Type F pump is entirely hydraulically shifted without the mechanical initiation found in the PowerLift I type pump so that the Type F pump can stall when operated at slow speeds. In addition, the Type F pump uses a bleed valve at the pump's discharge, which can be undesirable in some implementations.

What is needed is a hydraulically actuated pump that can operate at slow speeds but that can also reduce or prevent issues with gas lock conventionally found in such pumps.

SUMMARY

A hydraulic pump has an engine that is hydraulically actuated by power fluid communicated to the pump via tubing. A reversing valve in the engine controls the flow of the power fluid inside the engine and controls the flow of spent power fluid from the engine to a pump piston disposed in a pump barrel. Moved by the engine, the pump piston moves in upward and downward strokes and varies separate upper and lower pump volumes in the pump barrel.

The hydraulic pump disclosed herein avoids problems with gas lock found in conventional pumps. To do this, the pump compresses discharge fluid to a discharge pressure and expels an entire volume of the discharge fluid to the annulus during operation. During the upstroke, for example, the pump piston draws production fluid through an inlet valve into the pump's lower volume and discharges produced fluid and spent power fluid in the pump's upper volume through a discharge outlet to the annulus between the pump and the bottom hole assembly. During the downstroke, the produced fluid in the pump's lower volume is redirected through a first check valve to the pump's upper volume. During the upstroke, this first check valve prevents the produced fluid in the pump's upper volume from being redirected to the pump's lower volume. Instead, a second check valve controls flow of the fluid in the pump's upper volume to the discharge outlet.

The volume of the spent power fluid directed from the engine to the pump's upper volume during the upstroke is greater than the pump's upper volume. Because the spent power fluid is typically water, oil, or some other incompressible liquid, the fluid in the pump's upper volume during the upstroke will have enough liquid to be discharged from the upper pump volume to the annulus regardless of the amount of produced gas contained in the upper volume. With the decreasing of the upper pump volume, the pump piston can also compress any compressible portion of the fluid in this upper volume. Eventually during the upstroke, the bias of the second check valve opens at a discharge pressure in response to the decreasing upper pump volume, and the entire volume of fluid in the upper pump volume (except of course for remnants in some spaces) is expelled out of the upper volume when discharging fluid out of the pump. These operations of the pump all combine together to prevent gas lock.

DETAILED DESCRIPTION

Figure 1:
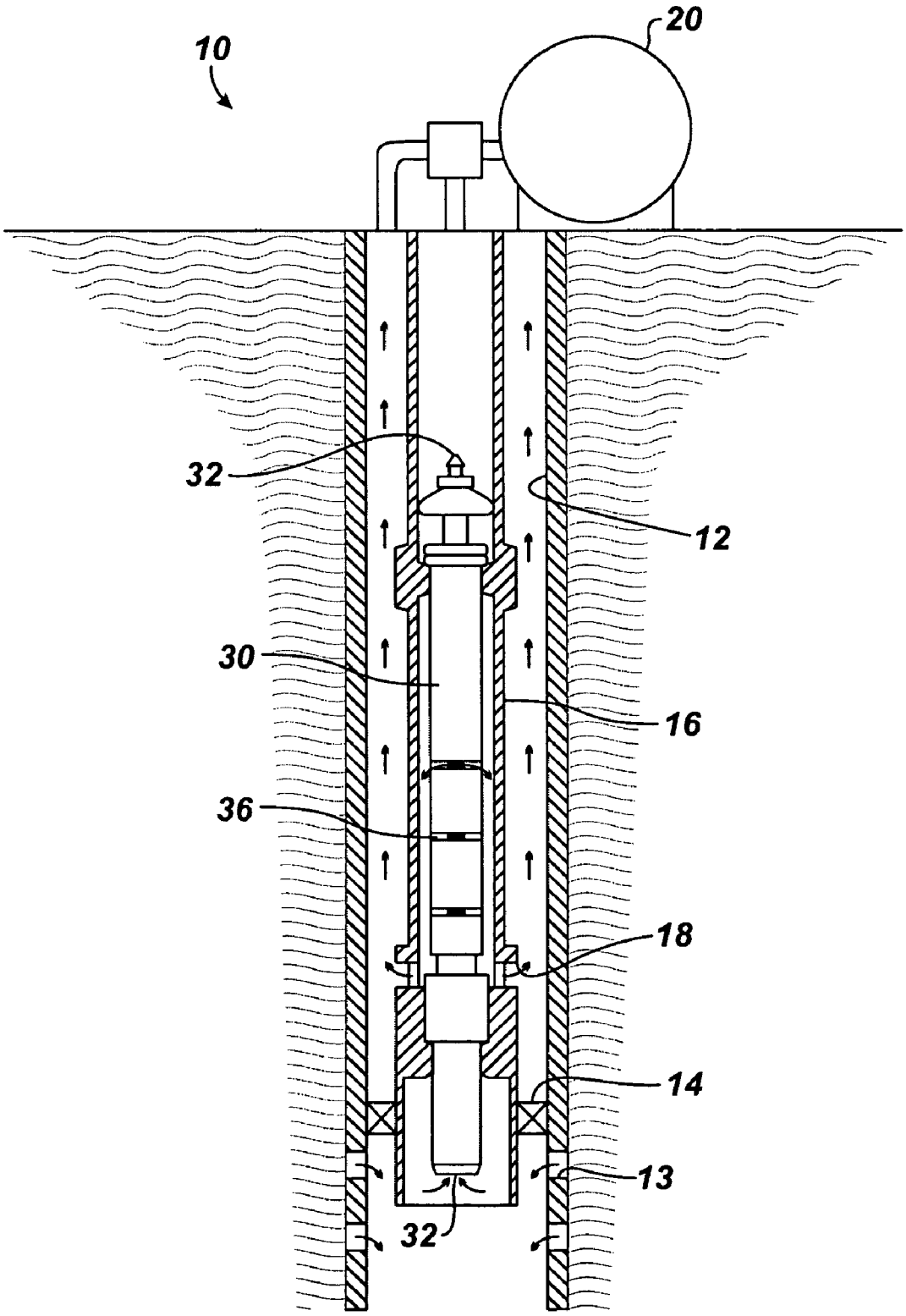
FIG. 1 (Prior Art)
FIG. 1 illustrates a pump according to the prior art disposed in production tubing in a wellbore.
Figure 2A:
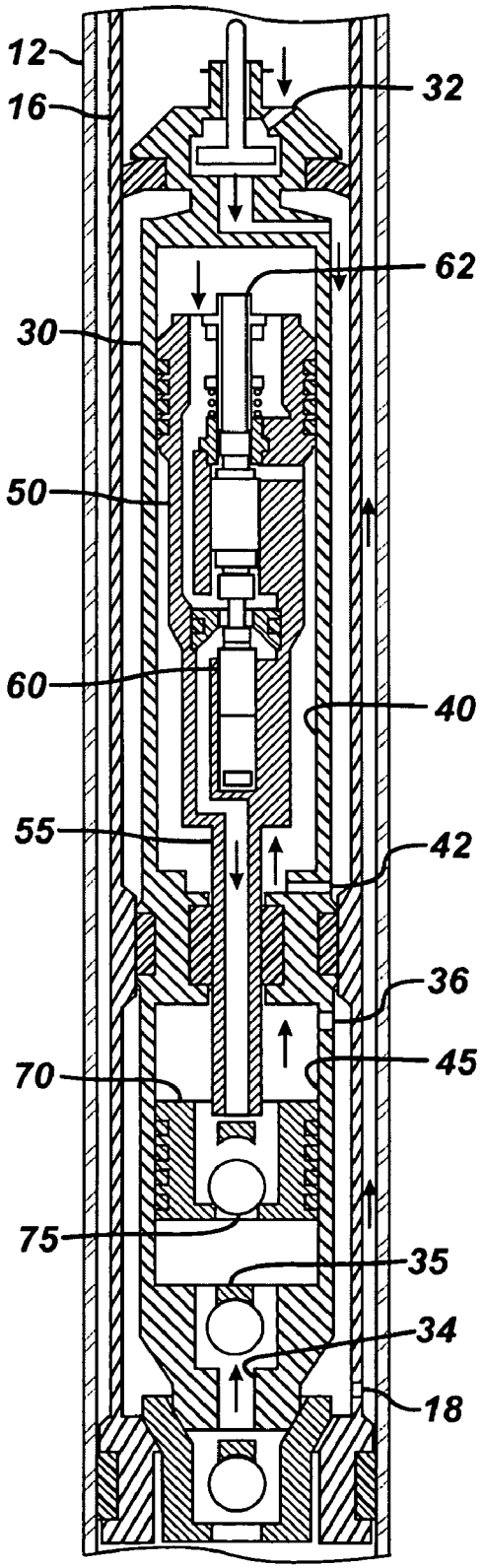
FIG. 2A (Prior Art)
FIG. 2A shows a cross-section of the prior art pump during an upstroke.
Figure 2B:
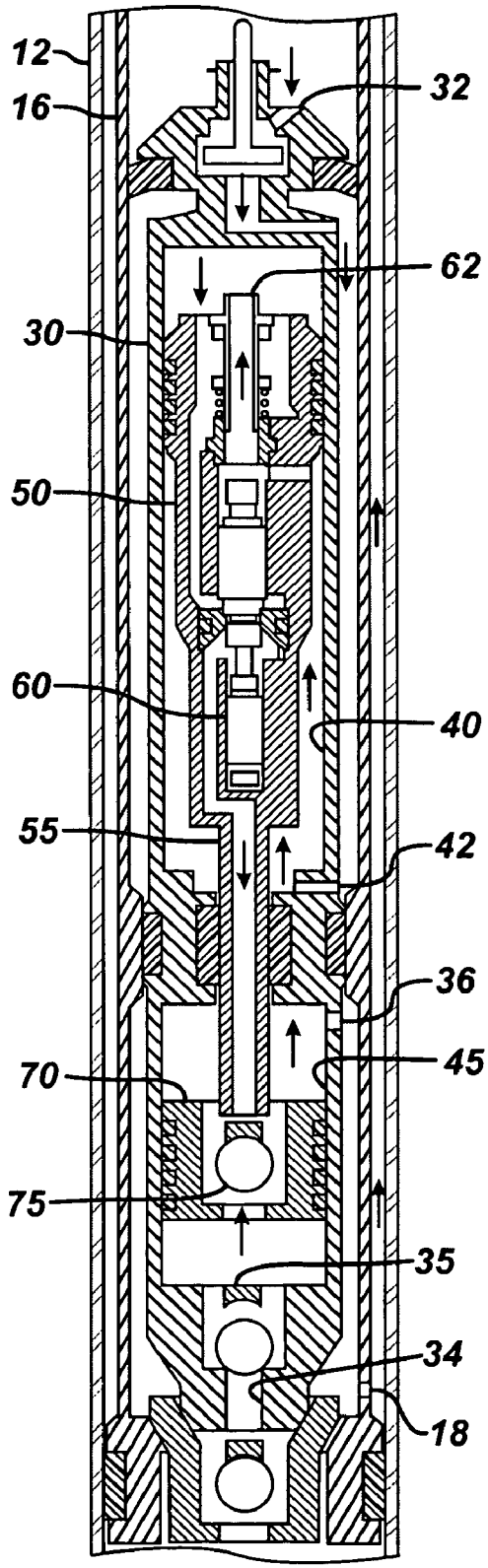
FIG. 2B (Prior Art)
FIG. 2B shows a cross-section of the prior art pump during a downstroke.
Figure 3A:
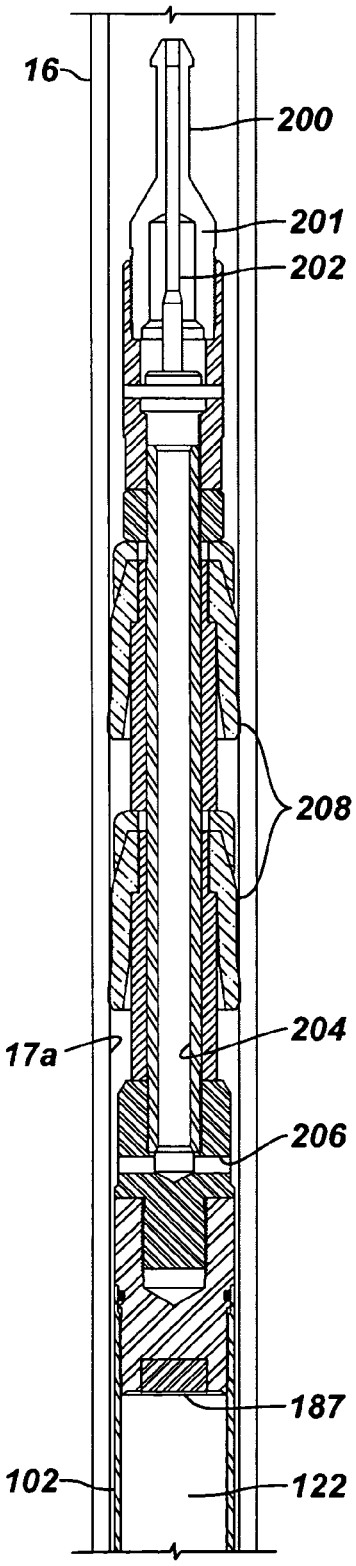
FIGS. 3A-3E illustrate a cross-sectional view of a hydraulically actuated pump according to the present disclosure during an upstroke.
Figure 3B:
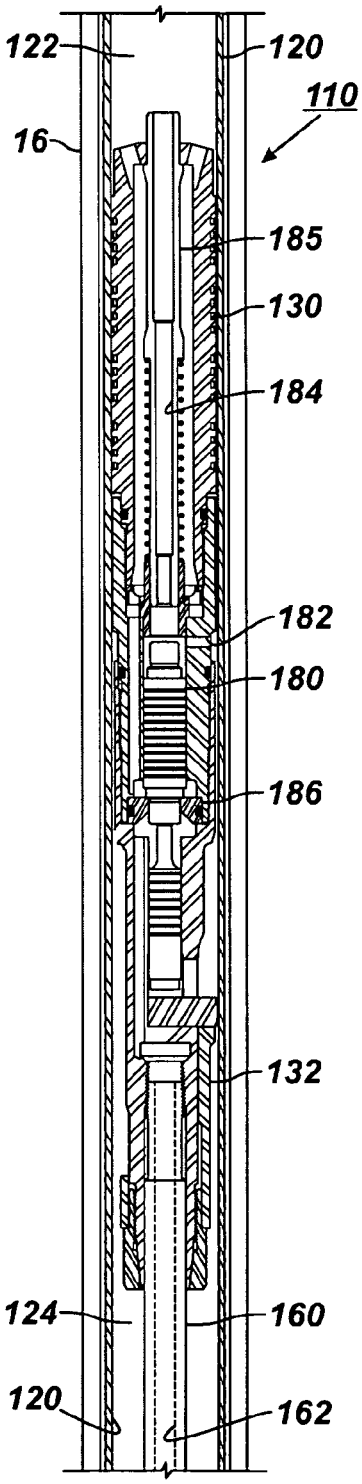
Figure 3C:
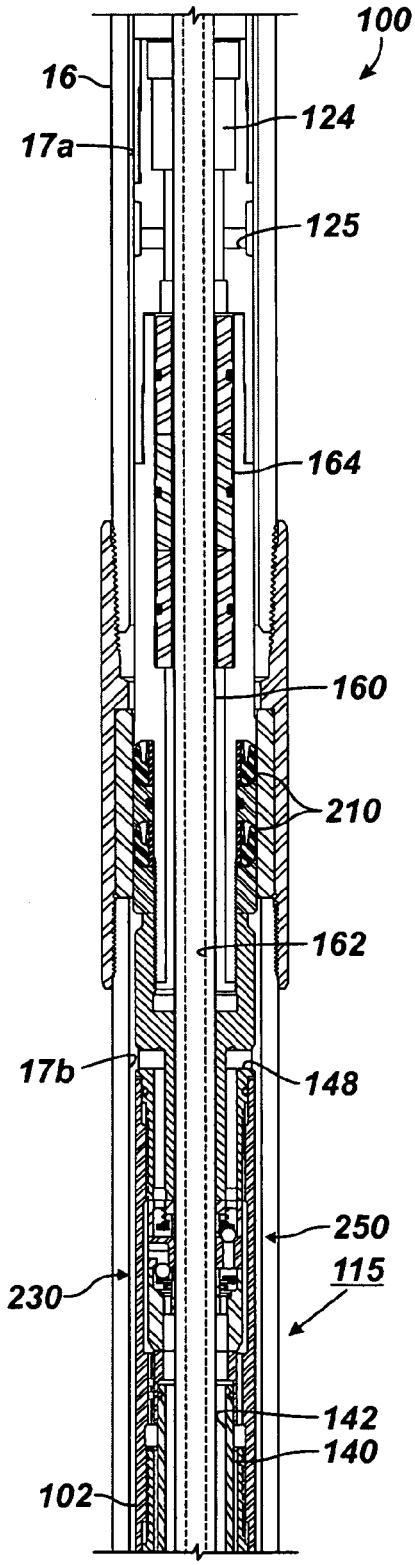
Figure 3D:
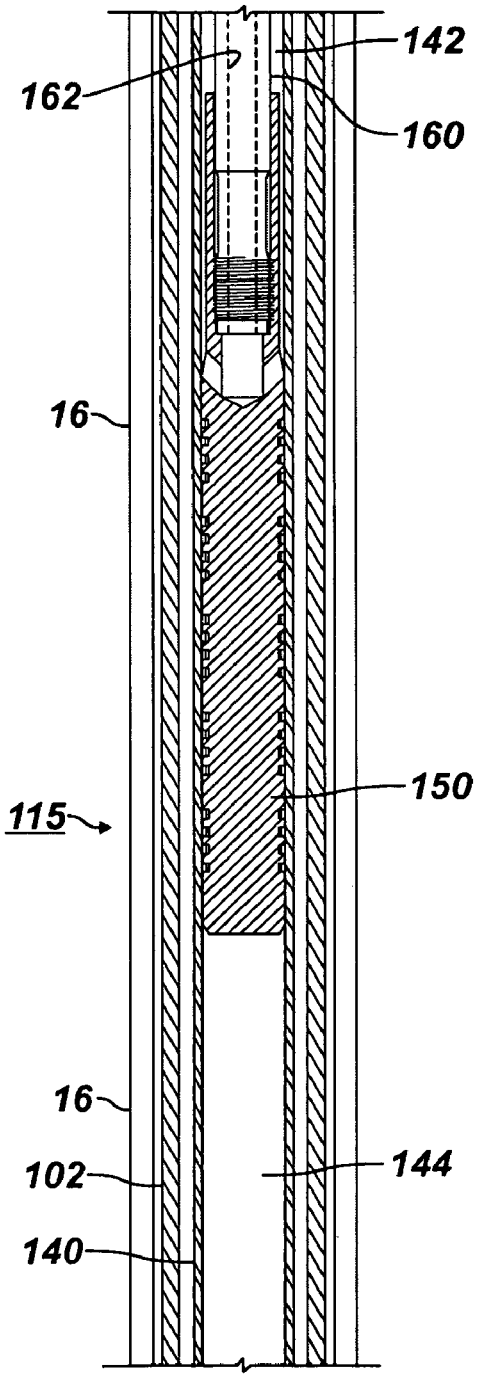
Figure 3E:
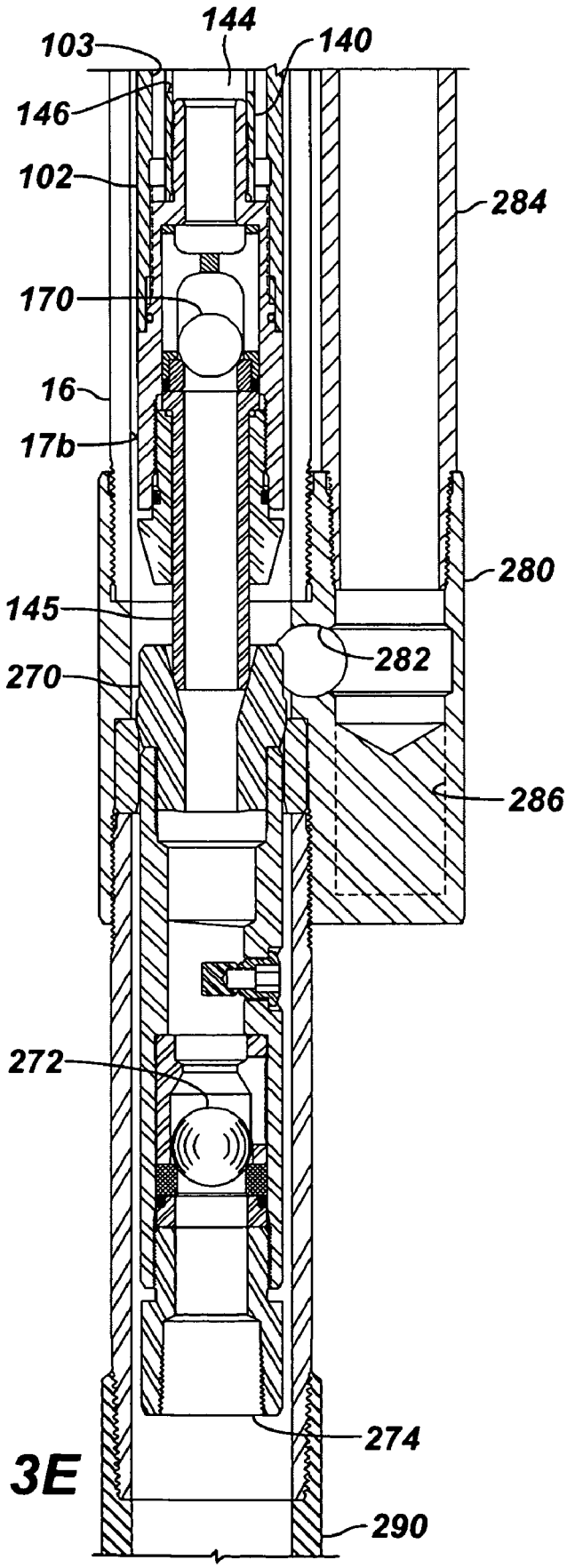
Figure 4A:
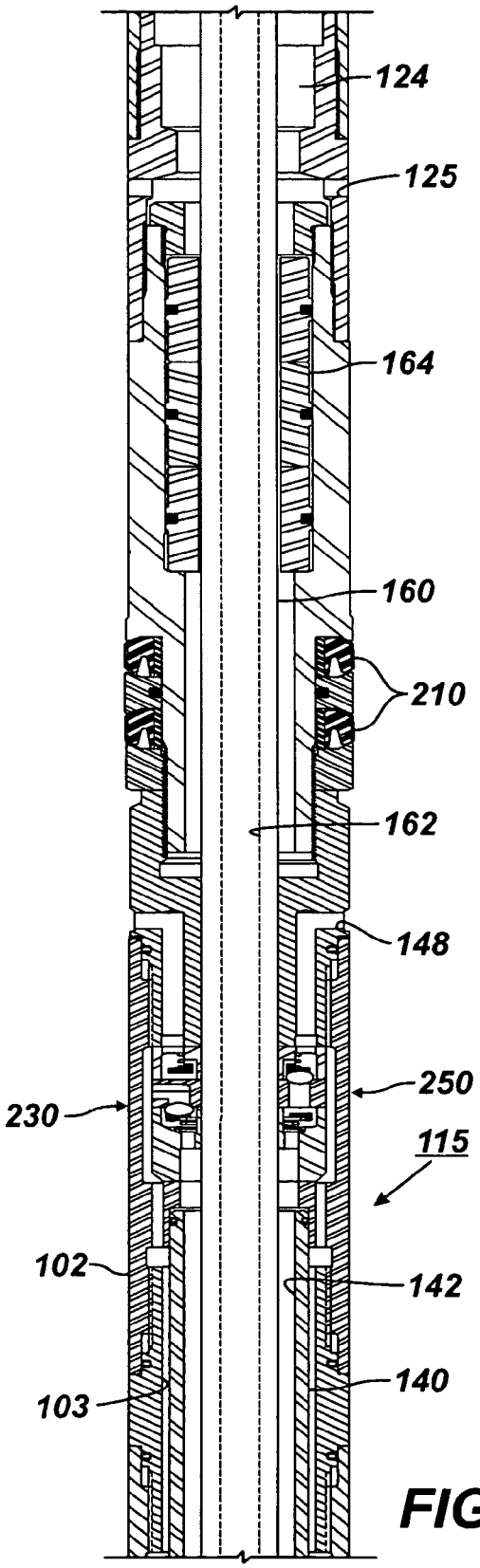
FIGS. 4A-4B show the pump section of the disclosed pump in additional detail.
Figure 4B:
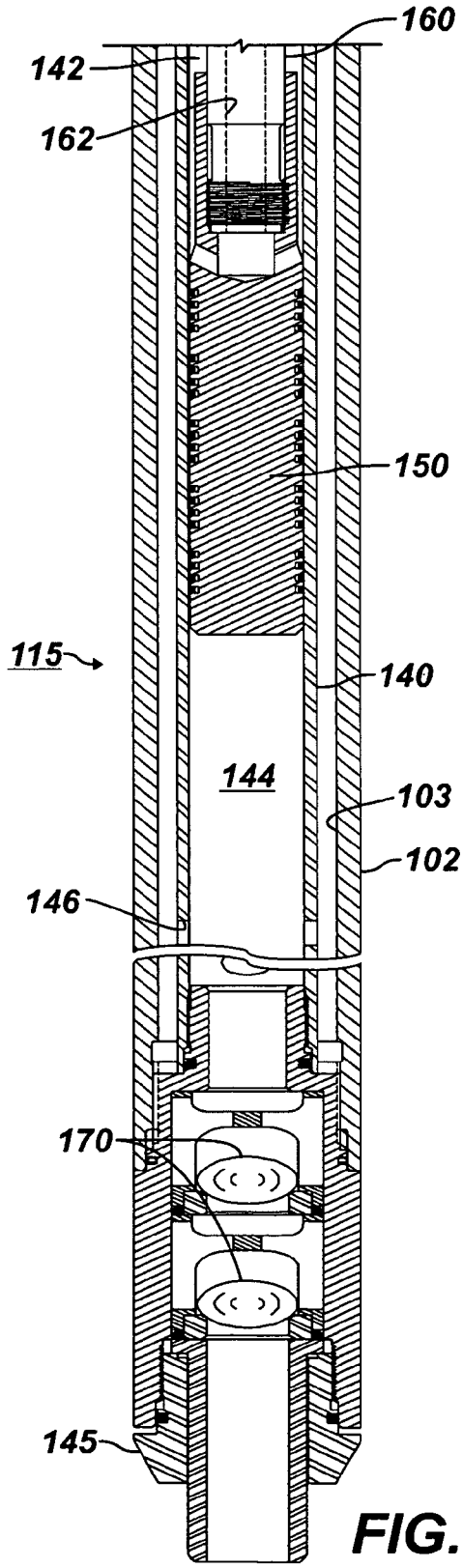

A hydraulically actuated pump 100 shown in FIGS. 3A-3E has an engine section 110 (shown primarily in FIGS. 3A-3C) and a pump section 115 (shown primarily in FIGS. 3C-3E and also shown in isolated detail in FIGS. 4A-4B). As shown in FIG. 3B, the engine section 110 has an engine piston 130 movably disposed within an engine barrel 120. As shown in FIG. 3D, the pump section 115 has a pump piston 150 movably disposed within a pump barrel 140, which is separate from the engine barrel 120. A rod 160 shown in FIGS. 3C-3D interconnects these two pistons 130/150 so that the two pistons 130/150 move in tandem in their respective barrels 120/140. The rod 160 has an internal passage 162 and passes through seal elements 164 (FIG. 3C) where the engine and pump barrels 120/140 are divided from one another. These seal elements 164 isolate fluid from passing on the outside of the rod 160 between the barrels 120/140. However, as discussed later, the rod's passage 162 does allow fluid to communicate between the barrels 120/140 during operation of the pump 100.

Briefly, the engine piston 130 is hydraulically actuated between upward and downward strokes by power fluid communicated from the surface to the pump 100 via tubing 16. As the engine piston 130 strokes, the pump piston 150 is moved in tandem with the engine piston 130 by the rod 160. The pump piston 150 varies two volumes 142/144 of its barrel 140, sucks in production fluid into volume 144, and discharges produced fluid and spent power fluid out of volume 142 in the process. To actuate the engine section 110, a reversing valve 180 (FIG. 3B) is disposed in the engine piston 130. This reversing valve 180 controls the flow of the power fluid within separate volumes 122/124 of the engine barrel 120 and controls the flow of the spent power fluid from the engine barrel 120 to the pump barrel 140.

With a basic understanding of the pump 100, discussion now turns to further details of the pump 100 and its operation. As noted previously, power fluid communicated to the pump 100 via the tubing 16 actuates the pump 100. Turning first to the engine section 110 (shown primarily in FIGS. 3A-3C), the power fluid enters the top of the pump 100 via a head 200 (FIG. 3A) having ports at 201 and having a check valve 202. Entering the ports at 201 and passing through a passage 204, the power fluid travels out cross ports 206 and into an annulus 17*a* between the tubing 16 and the pump's housing 102. Seating cups 208 (FIG. 3A) and 210 (FIG. 3C) isolate this portion of the annulus 17*a* from the rest of the tubing 16. Eventually, the power fluid in the annulus 17*a* enters the engine barrel 120 through cross ports 125 (FIG. 3C). (Passage of the power fluid from the tubing 16 to the engine barrel 120 is also shown in the schematic illustration of the pump 100 in FIG. 6A).

Power fluid from the cross ports 125 enters the lower engine volume 124. Filling this lower volume 124, the power fluid interacts with the surfaces of the reversing valve 180 (FIG. 3B) and moves the valve 180 to either an upper or lower position on the piston 130. Depending on pressure levels and the current stroke of the pump 100, the power fluid shifts the valve 180 from one position to the other, thereby controlling the flow of the power fluid in the engine section 110 and controlling the strokes of the pump 100.

Figure 5A:
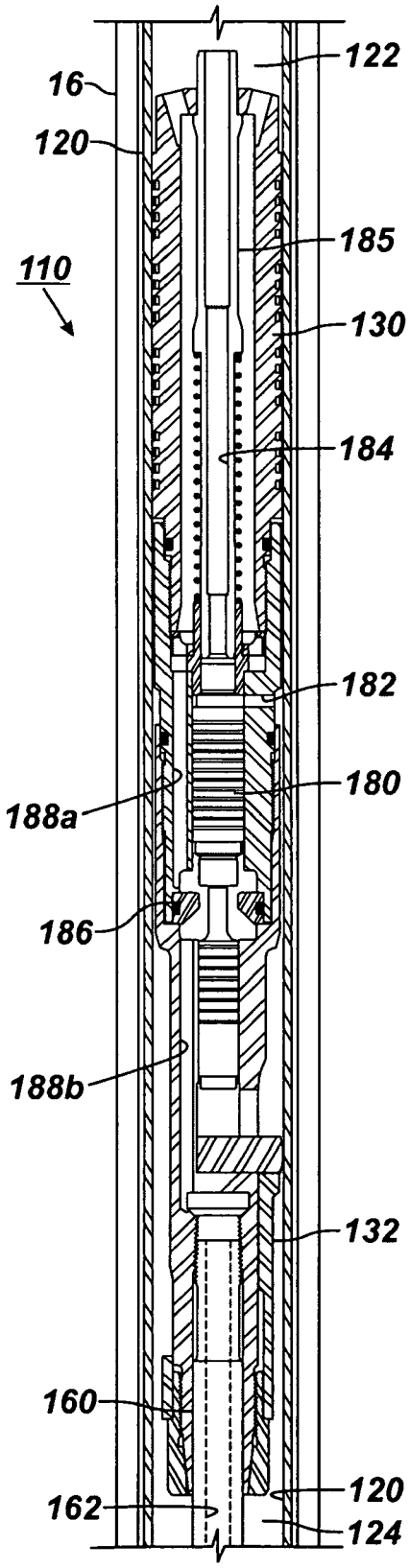
FIGS. 5A-5B show portions of the disclosed pump during a downstroke.

In FIG. 3B, the reversing valve 180 is shown in its lower position during the pump's downstroke. In FIG. 5A, the valve 180 is shown in its upper position in FIG. 5A during the pump's upstroke. Looking at this upper position in FIG. 5A, the reversing valve 180 closes off a side passage 182 and restricts the flow of power fluid from the engine's lower volume 124 into the upper volume 122. Yet, the reversing valve 180 moved from its seat 186 permits the spent power fluid in the engine's upper volume 122 to pass through side passages 188*a* and 188*b* and into the rod's passage 162. Thus, during the upstroke with the valve 180 in its upward position, power fluid entering the engine section 110 only acts upon the engine piston's lower end, thereby urging the engine piston 130 upward in the housing 102. In addition, the reversing valve 180 in its upward position routes the spent power fluid above the engine piston 130 to the pump's upper volume 142 where it can mix with produced fluid.

Figures 6A, 6B:
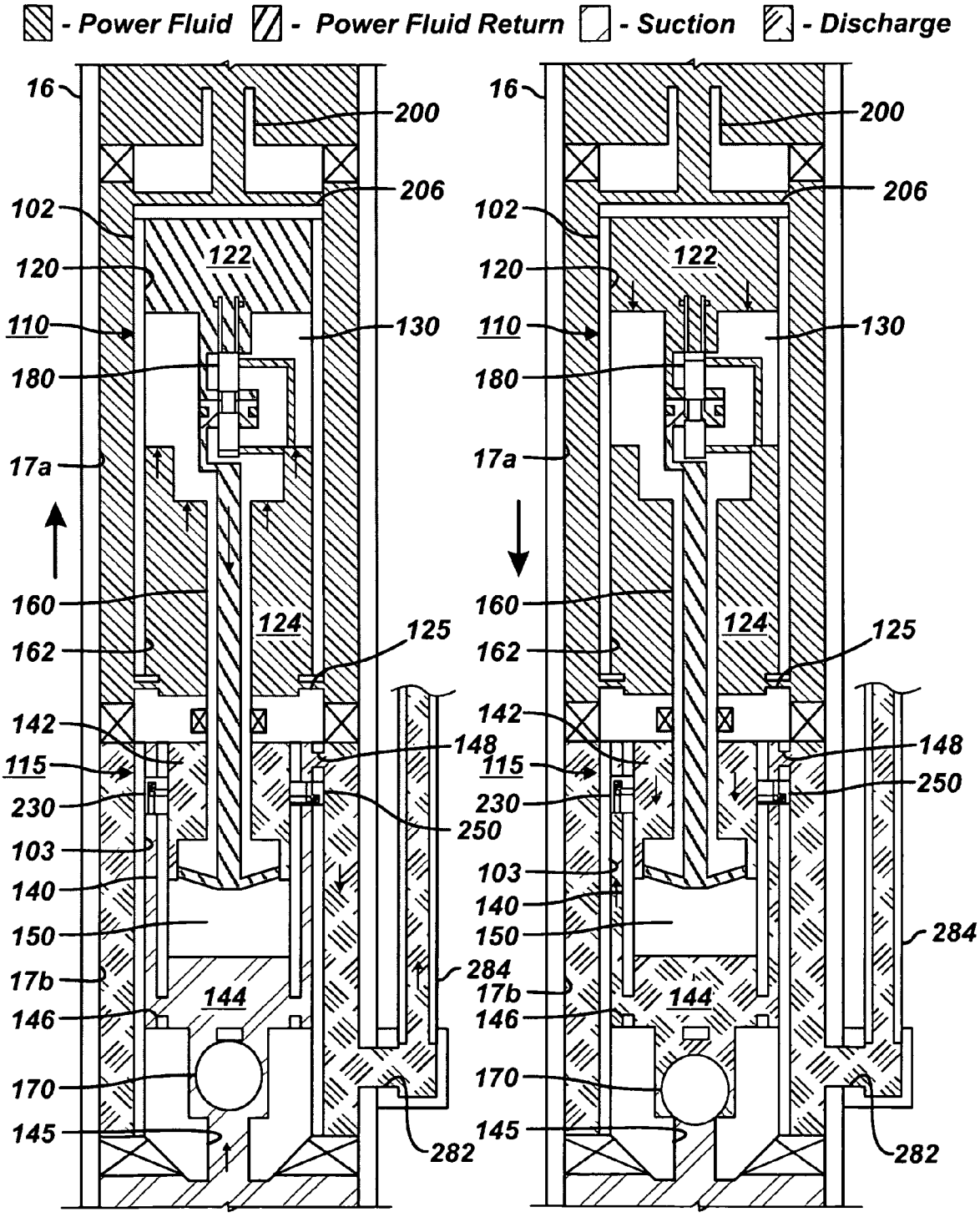
FIG. 6A shows a schematic view of the disclosed pump during an upstroke.
FIG. 6B shows a schematic view of the disclosed pump during a downstroke.

In the upstroke, the engine piston 130 draws the pump piston 150 (FIG. 3D) upward via the interconnecting rod 160. Focusing now on the pump section 110 (shown primarily in FIGS. 3C-3E and shown in isolated detail in FIGS. 4A-4B), the upward drawn pump piston 150 decreases its barrel's upper volume 142 while increasing the lower volume 144. The suction induced in the lower volume 144 draws in production fluid as one or more standing valves 170 (FIG. 3E) open and allow the fluid to enter the production fluid inlet 145. (Drawing of production fluid into the pump's lower volume 142 during the upstroke is shown in FIG. 6A).

FIG. 3E shows one standing valve 170, while FIG. 4B shows two standing valves 170. The standing valves 170 can be ball valves each having a ball movable relative to a seat, although other types of valves can be used. In addition to standing valves, a production fluid valve 272 may also be used at the bottom of the assembly as shown in FIG. 3E.

At the pinnacle of the upstroke, the pump 100 starts its downstroke with the reversing valve 180 shifting to its lower position shown in FIG. 3B. Looking again at the pump's engine section 110 (shown primarily in FIGS. 3A-3C), an actuating pin 185 (FIG. 3B) abuts upper volume's top bumper 187 (FIG. 3A), mechanically initiating the shifting of the reversing valve 180 and allowing fluid pressure to motivate the valve 180 downward. Shifted to its lower position in FIG. 3B, the reversing valve 180 permits the power fluid to flow from the engine's lower volume 124 into the upper volume 122 via the side passage 182 and a conduit passage 184, which passes through the actuating pin 185. At the same time, the reversing valve 180 engages its seat 186 and restricts the power fluid in the upper volume 122 from flowing into the rod's passage 162. As a result, a volume of spent power fluid remains in the rod 160, but power fluid is allowed to fill the engine's upper volume 122. (Travel of power fluid in the engine section 110 during the downstroke is shown in FIG. 6B).

Because the engine piston 130's area in the upper volume 122 is greater than its area in the lower volume 124, the power fluid exerting pressure in the upper volume 122 urges the engine piston 130 downward, moving the pump piston 150 (FIG. 3D) downward as well. Focusing again on the pump section 110 (shown primarily in FIGS. 3C-3E and shown in isolated detail in FIGS. 4A-4B), the lower pump volume 144 decreases, while the upper volume 142 increases as the pump piston 150 urges downward in the piston barrel 140. In addition, the one or more standing valves 170 close and prevent the produced fluid in the lower volume 144 from being expelled. Instead, the produced fluid in the lower volume 144 is forced out through the cross ports 146 (FIG. 3E) into an annulus 103 between the pump's barrel 140 and the housing 102. Traveling up this annulus 103, the produced fluid being sufficiently pressurized passes through a first internal valve 230 (FIG. 3C) and is drawn into the pump's increasing upper volume 142. (Travel of produced fluid in the pump section 115 during the downstroke is best shown in FIG. 6B).

Looking again at the pump's engine section 110 (shown primarily in FIGS. 3A-3C), a shifter 132 on the engine piston 130 engages the lower end of the barrel 120 at or near the low point of the downstroke and mechanically initiates movement of the reversing valve 180 upward so that the power fluid in the engine section 110 can motivate the reversing valve 180 to its upward position as shown in FIGS. 3C and 5A. The shifted valve 180 in this upward position blocks passage of the power fluid to the engine's upper volume 122. The build-up of power fluid in the lower volume 124 causes the engine piston 130 to urge upward in an upstroke, while the spent power fluid in the upper volume 122 passes through the shifting valve 180 and the rod's passage 162 to the pump's upper volume 142. (Travel of spent power fluid from the engine section 110 to the upper pump volume 142 during the upstroke is shown in FIG. 6A).

Focusing again on the pump section 110 (shown primarily in FIGS. 3C-3E and shown in isolated detail in FIGS. 4A-4B), the pump piston 150 (FIG. 3D) moves upward with the engine piston's movement upward. This increases the pump section's lower volume 144 to draw in new production fluid though the one or more open standing valves 170. However, the upward moving pump piston 150 also decreases the pump's upper volume 142, which already contains the previously produced fluid and now fills with the spent power fluid conveyed by the rod's passage 162 from the engine section 110. (Flow of spent power fluid and previously produced fluid in the pump's upper volume 142 during the upstroke is shown in FIG. 6A).

During the upstroke and as shown in FIG. 3C, the fluid in the pump's upper volume 142 is discharged at sufficient discharge pressure through a second internal valve 250, out a discharge outlet 148, and into an annulus 17*b* between the pump's housing 102 and the surrounding tubing 16. As shown in FIG. 3E, the discharged fluid in the annulus 17*b* eventually travels through a passage 282 in an assembly 280 connecting the tubing 16 to a parallel string 284 that carries the discharged fluid uphole. (Passage of discharged fluid to the parallel string 284 during the upstroke is shown in FIG. 6A). Although depicted in a free parallel arrangement, the pump 100 can be deployed using other arrangements known in the art, such as a fixed insert or a concentric fixed arrangement.

If the fluid in the pump's upper volume 142 is not entirely incompressible fluid, the second internal valve 250 permits compressible fluid in this volume 142 to be compressed during the upstroke before discharging the fluid through the outlet 148. Thus, the fluid in the upper volume 142 can be part liquid and part gas (i.e., the spent power fluid being liquid, while the produced fluid diverted to the upper volume 142 being entirely or partially gas). In either case, the volume of the spent power fluid conveyed by the rod's passage 162 from the engine's upper volume 122 during the upstroke will be greater than the produced fluid (gas and/or liquid) diverted to the pump's upper volume 142. Thus, any gas in the upper pump volume 142 can be compressed by the upward moving pump piston 150 to discharge pressure, and all of the fluid in upper pump volume 142 can be discharged through internal valve 250, out the outlet 148, and into the annulus 17*b*. By compressing any gas in the pump's upper volume 142 and discharging all the fluid above the pump piston 150 (except for a small remnant in various spaces), the pump 100 does not reach a situation where the pump piston 150 merely compresses gas in its upper volume 142 but fails to discharge any fluid out of the pump 100. In this way, the pump 100 can avoid issues with gas lock found in conventional assemblies.

Figure 5B:
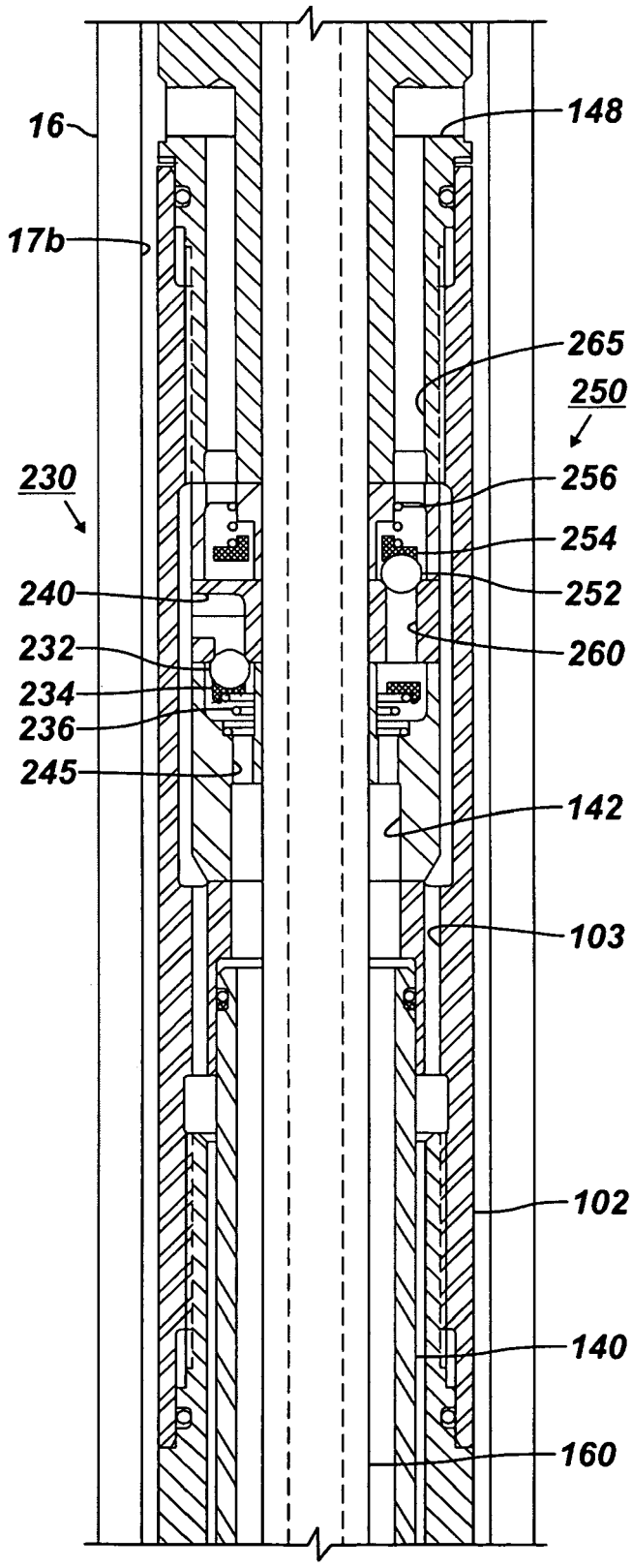

The internal valves 230/250 are shown in more detail in FIG. 5B. As noted previously, the first internal valve 230 controls fluid communication from the pump's lower volume 144 to its upper volume 142 (FIG. 3D). As shown in FIG. 5B, the internal valve 230 is a check valve that allows fluid flow in one direction when a sufficient fluid pressure is reached to open the valve. The check valve 230 has an inlet 240 in fluid communication with the pump's lower volume 144 (FIG. 3D) via the annulus 103 and has an outlet 245 in fluid communication with the pump's upper volume 142. A spring 236 or other biasing element disposed in a pocket biases a ring 234 toward the inlet 240. Disposed between this ring 234 and the inlet 240, at least one ball 232 seats against the inlet 240 to restrict fluid flow therethrough. Sufficient pressure exerted by produced fluid on the check valve 230 opens the valve 230 and allows the produced fluid to pass therethrough to the pump's upper volume 142.

The second internal valve 250 is similar to the first valve 230 and has at least one ball 252, a ring 254, and a spring 256. However, this second valve 250 has a reverse arrangement to control fluid flow from the upper pump volume 142 via inlet 260 to the pump's discharge outlet 148 via outlet 265. Thus, sufficient pressure exerted by fluid in the pump's upper volume 144 on this second valve 250 opens the valve 250 and allows the fluid to pass therethrough to the discharge outlet 148.

In addition to handling gas lock issues, the disclosed pump 100 also has features for handling any debris that may be present during operation. Fundamentally, the pump 100's low speed operation helps to keep the velocity of produced fluid low enough so that debris is not motivated or otherwise mobilized to enter the pump's inlet 145. Produced water from the reservoir (i.e., connate water) does not have a high debris carrying potential as long as its velocity remains low. Because the pump 100 can be operated at low speeds and keep the velocity of the produced fluid low, debris borne by the produced fluid may not be able to enter the pump's inlet 145 and may instead tend to collect and dune in the bottom of the casing.

To further handle debris that may attempt to enter the pump 100, a sand screen 290 shown in FIG. 3E can be connected near the intake 274 of the bottom hole assembly downhole from the pump's inlet 145. Although only a top portion is shown, the sand screen 290 has a mesh or the like (not shown) with passages that can prevent solid particulates in produced fluid from passing through the screen 290. In this way, the sand screen 290 can prevent debris from entering the intake 274, thereby preventing debris from disturbing the pump's operation.

If any very fine particles smaller than the passages in the sand screen 290 do enter the pump 100, however, a sump or volume 286 can be provided in the bottom hole assembly 280 of the free parallel arrangement in FIG. 3E. This sump 286 is downstream of the connecting passage 282 and can collect any produced debris that has passed through the pump 100. Although shown with a particular size, it will be appreciated that the sump 286 can be larger than shown and can also include a tubing member coupled to the assembly 280 downstream from the passage 282.

In addition to the above features, the pump 100 in some implementations may be fixed in the bottom hole assembly and may not be retrievable. In such a situation, the various flow passages inside the fixed pump 100 can be intentionally opened during operation to bypass solids through the pump 100. The need to perform such a bypass operation will most likely be needed when the pump 100 is being used to pump a mixture of water and coal fines.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A hydraulically actuated pump assembly, comprising:

an engine being hydraulically actuated by power fluid between first and second engine strokes;

a pump having first and second pump volumes variable by the first and second engine strokes;

a reversing valve disposed in the engine, the reversing valve controlling flow of the power fluid within the engine and controlling the flow of spent power fluid from the engine to the first pump volume;

an inlet valve disposed in the assembly and allowing production fluid to be drawn into the second pump volume during the first engine stroke;

a first check valve disposed in the assembly and controlling flow of fluid from the second pump volume to the first pump volume during the second engine stroke; and a second check valve disposed in the assembly and controlling flow of fluid from the first pump volume to a discharge outlet of the assembly during the first engine stroke.

2. The assembly of claim 1, wherein the second check valve permits compressible fluid in the first pump volume to be compressed during the first engine stroke before being discharged through the outlet.

3. The assembly of claim 1, wherein a volume of the spent power fluid permitted to flow by the reversing valve from the engine to the first pump volume is greater than the first pump volume.

4. The assembly of claim 1, wherein the pump expels an entire volume of the fluid in the first pump volume from the first pump volume during the first engine stroke.

5. The assembly of claim 1, wherein the engine comprises an engine piston movably disposed in an engine barrel and separating the engine barrel into first and second engine volumes, the second engine volume having an inlet for the power fluid.

6. The assembly of claim 5, wherein the reversing valve is disposed in the engine piston and is movable between first and second positions.

7. The assembly of claim 1, wherein the pump comprises a pump piston movably disposed in a pump barrel and separating the pump barrel into the first and second pump volumes, the second pump volume having an inlet for production fluid.

8. The assembly of claim 7, wherein a rod interconnects the engine and the pump piston and defines a passage for the spent power fluid permitted to flow by the reversing valve from the engine to the first pump volume.

9. The assembly of claim 1, wherein the inlet valve comprises at least one ball valve having a ball movable relative to a seat.

10. The assembly of claim 1, wherein the first check valve comprises a biased ball valve having an inlet in fluid communication with the second pump volume and having an outlet in fluid communication with the first pump volume.

11. The assembly of claim 10, wherein the inlet communicates with a space between a housing of the assembly and a barrel of the pump.

12. The assembly of claim 10, wherein the biased ball valve comprises:

a ring biased in a pocket between the inlet and the outlet; and at least one ball disposed between the ring and the inlet and being seatable against the inlet.

13. The assembly of claim 1, wherein the second check valve comprises a biased ball valve having an inlet in fluid communication with the first pump volume and having an outlet in fluid communication with the discharge outlet.

14. The assembly of claim 13, wherein the biased ball valve comprises:

a ring biased in a pocket between the inlet and the outlet; and at least one ball disposed between the ring and the inlet and being seatable against the inlet.

15. The assembly of claim 1, wherein shifting of the reversing valve is mechanically initiated.

16. The assembly of claim 1, further comprising a bottom hole assembly into which the pump assembly deploys, the bottom hole assembly having— a passage for communicating with the fluid from the discharge outlet of the pump assembly;

a string extending uphole from the passage for communicating the discharged fluid uphole; and a sump volume extending downhole from the passage for collecting debris in the discharged fluid.

17. The assembly of claim 1, further comprising a bottom hole assembly into which the pump assembly deploys, the bottom hole assembly having a sand screen downhole from the inlet valve of the pump assembly.

18. A hydraulically actuated pump assembly, comprising:

an engine having an engine piston movably disposed in an engine barrel and separating the engine barrel into first and second engine volumes, the second engine volume having a first inlet for power fluid;

a pump having a pump piston movably disposed in a pump barrel and separating the pump barrel into first and second pump volumes, the second pump volume having a second inlet for production fluid;

a rod interconnecting the engine piston and the pump piston;

an inlet valve disposed at the second inlet and allowing production fluid to be drawn into the second pump volume;

a reversing valve movably disposed in the engine piston, the reversing valve in a first position permitting fluid flow from the first engine volume to the first pump volume via a passage in the rod, the reversing valve in a second position permitting flow of spent power fluid from second engine volume to the first engine volume;

a first check valve disposed in the assembly and controlling fluid flow from the second pump volume to the first pump volume; and a second check valve disposed in the assembly and controlling fluid flow from the first pump volume to a discharge outlet of the assembly.

19. A hydraulically actuated pumping method for a well, comprising:

communicating power fluid to an engine deployed downhole;

stroking the engine with the power fluid between first and second strokes;

drawing production fluid into a second pump volume during the first stroke of the engine;

diverting the produced fluid in the second pump volume beyond a first pressure to a first pump volume during the second stroke of the engine;

communicating spent power fluid from the engine to the first pump volume during the first engine stroke; and discharging the fluid in the first pump volume beyond a second pressure out of the first pump volume during the first engine stroke.

20. The method of claim 19, wherein stroking the engine with the power fluid comprises shifting a reversing valve by mechanically initiating the reversing valve and motivating the reversing valve with the power fluid.

21. The method of claim 19, wherein drawing production fluid into the second pump volume comprises producing suction in the second pump volume and opening a valve at an inlet of the second pump volume.

22. The method of claim 19, wherein diverting the produced fluid in the second pump volume to the first pump volume comprises:

decreasing the second pump volume and increasing the first pump volume by moving a pump piston with the engine during the second engine stroke;

diverting the produced fluid from the decreasing second pump volume via a port;

communicating the diverted fluid from the port to a check valve; and communicating the diverted fluid to the increasing first pump volume by opening the check valve.

23. The method of claim 19, wherein communicating the spent power fluid from the engine to the first pump volume during the first engine stroke comprises:

shifting a reversing valve in the engine;

increasing a second engine volume with the power fluid; and diverting the spent power fluid in a first engine volume by passing the spent power fluid through the reversing valve to the first pump volume.

24. The method of claim 19, wherein discharging the fluid comprises compressing any compressible portion of the fluid in the first pump volume during the first engine stroke.

25. The method of claim 19, wherein discharging the fluid comprises:

decreasing the first pump volume by moving a pump piston with the engine during the first engine stroke;

diverting the fluid from the decreasing first pump volume via a port;

communicating the diverted fluid from the port to a check valve; and communicating the diverted fluid to a discharge outlet by opening the check valve.

26. The method of claim 19, wherein stroking the engine with the power fluid comprises stroking the engine at a low speed to inhibit the velocity of the production fluid from motivating debris into the second pump volume.

27. The method of claim 19, wherein drawing production fluid into the second pump volume comprises screening debris from the production fluid.

28. The method of claim 19, wherein discharging the fluid in the first pump volume comprises collecting debris in the discharged fluid in a sump volume.

29. The assembly of claim 1, wherein to control the flow of fluid from the second pump volume to the first pump volume during the second engine stroke, the first check valve restricts the flow of fluid from the second pump volume to the first pump volume up until a first threshold during the second engine stroke.

30. The assembly of claim 29, wherein the first check valve prevents the flow of fluid from the first pump volume to the second pump volume during the first and second engine strokes.

31. The assembly of claim 1, wherein to control the flow of fluid from the first pump volume to the discharge outlet of the assembly during the first engine stroke, the second check valve restricts the flow of fluid from the first pump volume to the discharge outlet up until a second threshold during the first engine stroke.

32. The assembly of claim 31, wherein the second check valve prevents the flow of fluid from the discharge outlet to the first pump volume during the first and second engine strokes.

33. The assembly of claim 1, wherein the first and second check valves remain stationary in the assembly relative to the pump.

34. The method of claim 19, wherein diverting the produced fluid in the second pump volume beyond the first pressure to the first pump volume comprises restricting flow of the produced fluid from the second pump volume to the first pump volume up until the first pressure during the second engine stroke.

35. The method of claim 34, wherein diverting the produced fluid in the second pump volume beyond the first pressure to the first pump volume comprises preventing flow of the produced fluid from the first pump volume to the second pump volume during the first and second engine strokes.

36. The method of claim 19, wherein discharging the fluid in the first pump volume beyond the second pressure out of the first pump volume during the first engine stroke comprises restricting flow of the fluid from the first pump volume to a discharge outlet up until the second pressure during the first engine stroke.

37. The method of claim 36, wherein discharging the fluid in the first pump volume beyond the second pressure out of the first pump volume during the first engine stroke comprises preventing flow of the fluid from the discharge outlet to the first pump volume during the first and second engine strokes.

* * * * *

UNITED STATES PATENT AND TRADEMARK OFFICE

CERTIFICATE OF CORRECTION

PATENT NO. : 8,303,272 B2
APPLICATION NO. : 12/402316
DATED : November 6, 2012
INVENTOR(S) : Pugh et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 594 days.

Signed and Sealed this
Eighth Day of January, 2013

David J. Kappos

David J. Kappos
*Director of the United States Patent and Trademark Office*